US008079491B2

(12) United States Patent
Williams

(10) Patent No.: US 8,079,491 B2
(45) Date of Patent: Dec. 20, 2011

(54) CRATE SYSTEM

(76) Inventor: Marty Williams, Colorado Springs, CO (US)

( * ) Notice: Subject to any disclaimer, the term of this patent is extended or adjusted under 35 U.S.C. 154(b) by 1102 days.

(21) Appl. No.: 10/711,961

(22) Filed: Oct. 15, 2004

(65) Prior Publication Data

US 2006/0081630 A1 Apr. 20, 2006

(51) Int. Cl.

| | |
|---|---|
| ***B65D 6/00*** | (2006.01) |
| ***B65D 8/04*** | (2006.01) |
| ***B65D 8/18*** | (2006.01) |
| ***B65D 90/02*** | (2006.01) |

(52) U.S. Cl. ..... 220/668; 220/1.5; 206/335

(58) Field of Classification Search ..... 220/485, 220/668; 211/85.31, 85.7, 182, 191, 194, 211/195, 206; 206/335, 448

See application file for complete search history.

(56) References Cited

U.S. PATENT DOCUMENTS

| | | | | |
|---|---|---|---|---|
| 2,345,650 | A * | 4/1944 | Attwood | 403/21 |
| 3,178,216 | A * | 4/1965 | Richard | 294/68.1 |
| 3,363,800 | A * | 1/1968 | Anderson | 220/4.01 |
| 5,520,316 | A * | 5/1996 | Chen | 224/539 |
| 6,123,208 | A * | 9/2000 | Haenszel | 211/175 |
| 6,726,041 | B2 | 4/2004 | Dunn | 211/194 |
| 2004/0168946 | A1 * | 9/2004 | Angeletti et al. | 206/448 |

* cited by examiner

*Primary Examiner* — Harry Grosso

(74) *Attorney, Agent, or Firm* — Apex Juris, pllc; Tracy M. Heims

(57) ABSTRACT

A crate system for transport of items. The system includes a set of U shaped tubes that are mounted in an upright position on beams. A second set of U shaped tubes are also mounted in an upright position on beams. Each assembled set are then mounted on top of one another to form a crate system. The crate system can safely secure and even stack heavy items on top of one another. These crate systems can then be disassembled for packing and shipping back to the original shipper.

9 Claims, 5 Drawing Sheets

CRATE SYSTEM

FIELD OF THE INVENTION

This invention relates to the field of shipping crates for large items.

BACKGROUND OF THE INVENTION

Most manufactured items are packaged for shipment to their destination. This packaging may range from simple plastic and cardboard packaging for small consumer items to large wooden crates or containers for larger items. The larger crates can be quite cumbersome and complex in order to properly prevent damage to their contents. Often those crates are subject to mishandling and damage due to the use of equipment to manipulate them. Also, the crates and their contents must often be stacked on top of one another to provide for an efficient shipment.

These problems are particularly prevalent in the shipment of larger items such as snowmobiles, personal water craft or all terrain vehicles "ATVs" as well as other large items. These items tend to be large, bulky and heavy as well as susceptible to damage. The weight alone makes it difficult to stack these items without special precautions. The weight and bulk of these types of items render fiberboard, cardboard or plastic impractical for use in shipment.

Presently, these items are shipped in specially prepared wooden crates. A typical wooden crate consists of a framework of two by fours, cross-bracing timbers, and plywood panel sides. These wooden crates present a multitude of problems. The crates are relatively expensive to manufacture and to assemble. Once the items have been packed within the crates, it is difficult to inspect the items for customs, or for damage. The crates must be disassembled which typically damages the crate.

Wooden crates also are environmentally unsound, both from the viewpoint of the destruction of forest environment to create the raw materials, the disposal of the crates once they are discarded and from their inability to withstand environmental forces. The crates become weakened and damaged from rain, snow, ice and other environmental forces which can lead to damage to their contents. Certain countries, locales and companies will not accept shipments in wooden containers due to problems with insects and disease that may be carried in the wooden containers.

The disposal of the wooden crates is a major factor. The wooden components are normally discarded after use due to the damage suffered during shipment and unpacking. This creates additional cost in disposing of the disassembled components. Even if the components are reusable, the storage of those bulky components is costly.

SUMMARY OF THE INVENTION

The present invention provides an improved crate system that solves these and other problems. The crate system of the present system provides a lightweight crate system that is extremely strong yet is reusable. The crate system can also be disassembled for shipment or for compact storage.

The crate system of a preferred embodiment of the present invention includes a set of lightweight high strength structural tubes. These structural tubes are secured to beams to form the crate. The structural tubes can be fabricated in a substantially rectangular shape, or in another preferred embodiment, be fabricated in a substantially U shape. In the latter embodiment, the system can be assembled into lower and upper shells that are secured together to form a substantially rectangular shape. Other shapes can be formed by simply fabricating the structural tubes into a desired shape.

In a preferred embodiment of the present invention, the crate system is formed from structural tubing. The structural tubing can be hollow lightweight high strength steel tubing, such as one-half to one-inch tubing. Other sizes can be used as well as other material choices.

The crate system of a preferred embodiment may also incorporate beams, slats, open slot C channel members or other elongated members. This provides a high strength support structure to reinforce the structural tubes as well as to maintain the structural tubing in the desired spaced relationship to one another. The open slot C channel members also allow the fastening mechanisms for securing the structural tubes to the beams to be easily adjusted to the appropriate locations. In one preferred embodiment, the fastening mechanisms include spring nuts that are easily inserted into the channel members.

In the crate system of the preferred embodiment using an upper shell and a lower shell, beams are secured along the upper ends of the structural tubes to form a mechanism for securing the upper shell to the lower shell. The beams are secured by fasteners, such as dowel pins, spring loaded star nuts or simply by welding nuts to the upper ends.

The improved crate system of a preferred embodiment can be easily and quickly assembled with little skill necessary and only one wrench. The structural tubes are secured to the beams by a simple fastening system that aligns the structural tubes in the appropriate spacing. If the upper shell and lower shell system is used, those are easily secured together. The item can then be placed in the system either before or after the shells are fastened together. It can be shrink wrapped to allow viewing of the item for inspection or simply covered with cardboard or fiberboard. The crates can be safely stacked on top of one another without fear of damage to the crate or its contents.

Once the item is unpacked, the crate system can be partially disassembled to allow compact storage or completely disassembled for packing the components for return or for storage. The crate system can be reused numerous times or reused for other structures. The cost of shipping the crate system components is less than the current cost of disposing of wooden crate materials and certainly less than the cost of constructing a similar size of wooden crates.

The crate system can be easily scaled to ship most items, and has particular use for large items, such as all terrain vehicles, personal watercraft, snowmobiles, generators or other large items.

These and other features will be evident from the ensuing detailed description of preferred embodiments and from the drawings.

DETAILED DESCRIPTION OF PREFERRED EMBODIMENTS

Figure 1:
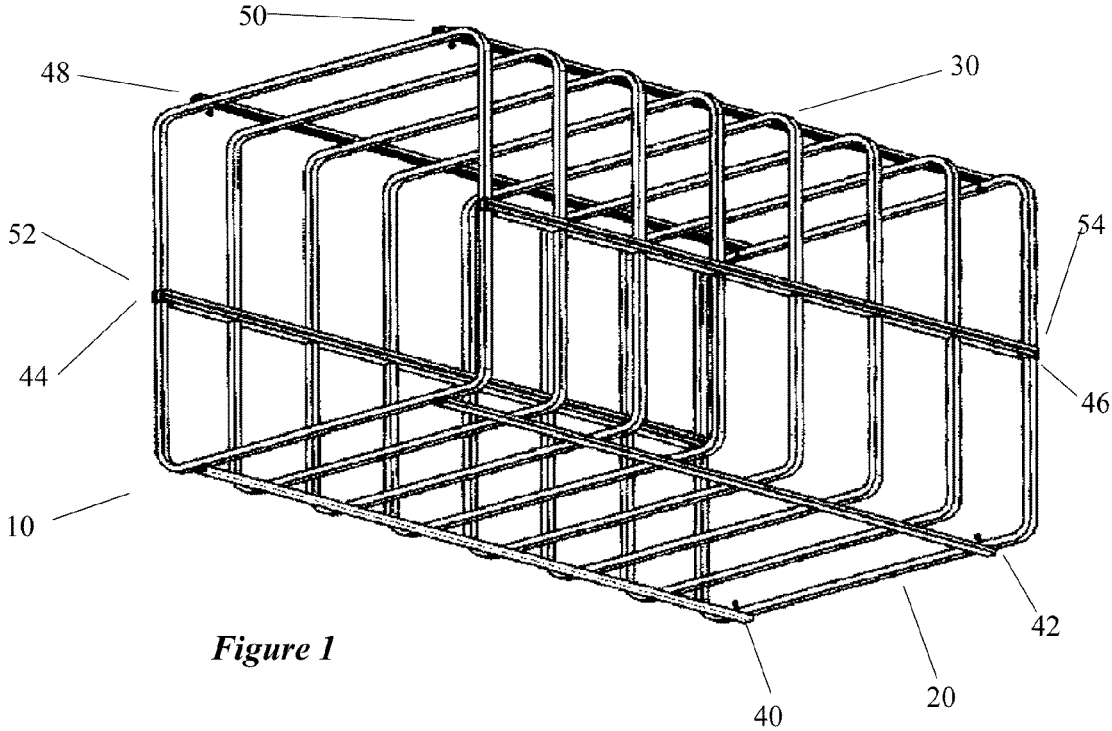
FIG. 1 illustrates the assembled crate system of a preferred embodiment of the present invention.

The present invention, in a preferred embodiment, provides an improved shipping crate system for large items. A preferred embodiment of the present invention is described below. It is to be expressly understood that this descriptive embodiment is provided for explanatory purposes only, and is not meant to unduly limit the scope of the present invention as set forth in the claims. Other embodiments of the present invention are considered to be within the scope of the claimed inventions, including not only those embodiments that would be within the scope of one skilled in the art, but also as encompassed in technology developed in the future.

A preferred embodiment of an improved shipping crate system of the present invention is illustrated in FIGS. 1-12. This preferred embodiment is described for use in shipping ATVs, snowmobiles, personal watercraft and other related items but it is expressly noted that other items may be used with the present invention. Also, the shipping crate system of the present invention may also be scaled down or up in size as desired for shipment of other items.

The preferred embodiment of the shipping crate system 10 includes spaced lower tubes 20 and upper tubes 30. In this preferred embodiment, the tubes 20 and 30 are fabricated from standard hollow steel tubing, preferably one-half inch to one inch square tubing. It is to be expressly understood that other sizes of tubing, types of tubing, such as C or U shaped tubing and even materials, such as high strength plastic can be used as well. The tubes 20 and 30 are fabricated into a U shape, as shown in the FIGS. 1-12. In this preferred embodiment, all of the lower tubes and upper tubes are identical to one another. It is to be understood that in other embodiments, the tubes may be of different sizes, strengths or shapes from one another. However, it in this embodiment, the tubes are all identical to provide efficient manufacturing, inventory and assembly.

Beams 40, 42, 44, 46, 48, 50, 52, 54 are integral to the crate 10. The beams provide the dual purpose of reinforcing the strength of the crate as well as to secure the tubes 20, 30 into an integral structure. The beams in this preferred embodiment are formed in a channel having an internal slot 56 with over-extending lips 58, 60. It is to be expressly understood that other types of beams may be used as well, such as tubing, other types of beams, slats or any other suitable member.

Figure 4:
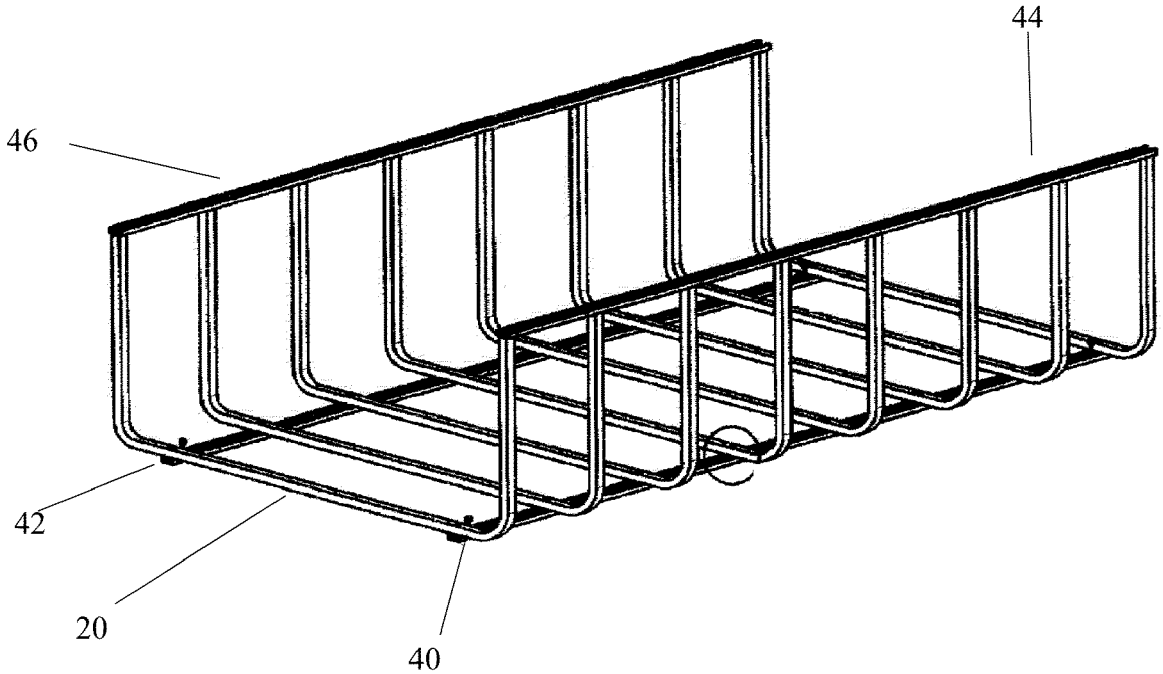
FIG. 4 illustrates a partially assembled lower shell of the crate system of FIG. 1.
Figure 5:
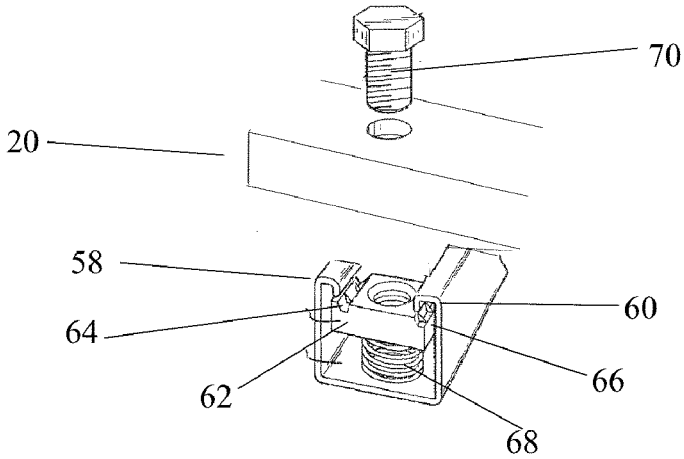
FIG. 5 illustrates an exploded view of the spring nut fastening system used in the embodiment of FIG. 1.
Figure 6:
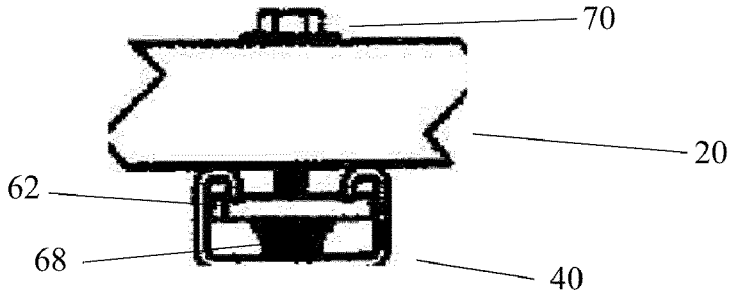
FIG. 6 illustrates a detail view of the assembled spring nut fastening system used in the embodiment of FIG. 1.

The lower tubes 20 are assembled as shown in FIG. 4. The tubes are mounted in an upright position on beams 40, 42 and spaced from one another. The tubes 20 include pre-drilled holes 22, 24 that are oriented directly over the channels 40, 42 that are spaced from one another in a parallel fashion. The tubes are then fastened to the channels 40, 42 by inserting spring nut 62 into the channel slot 56 as shown in FIGS. 5 and 6. The spring nut 62 includes a grooved upper surface 64, 66 that engages in the lips 58, 60. This engagement is secured by spring 68 that allows the nut 62 may be moved along the channel slot 56 as necessary. Bolt 70 engages through the pre-drilled hole in the tube 20 and engage spring nut 62 to secure the tube 20 to channel 40.

Figure 3:
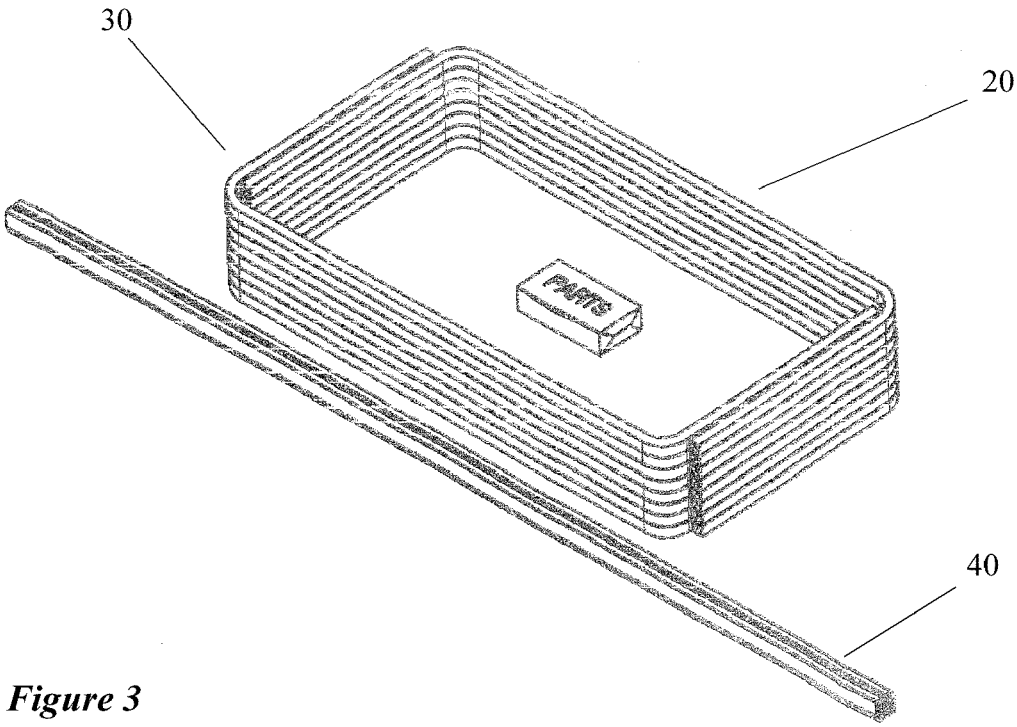
FIG. 3 illustrates the components of the crate system of FIG. 1.
Figure 9:
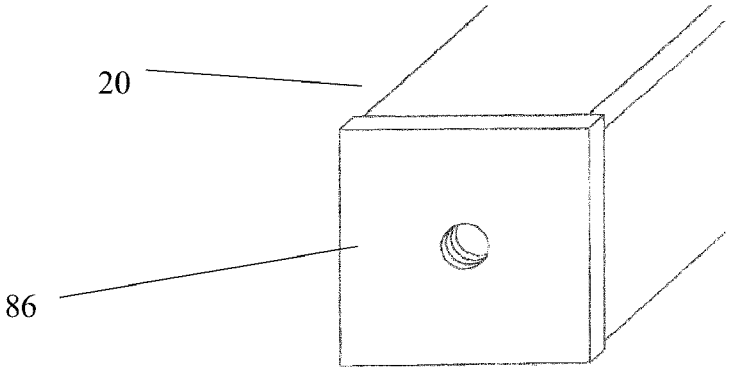
FIG. 9 illustrates an alternative fastening system.

Each of the tubes 20 are loosely secured onto the beams 40, 42 initially. Once each of the tubes 20 have been loosely secured onto the beams, then surface beams 44, 46 are mounted to the upper surfaces 24, 26 as shown in FIGS. 3 and 6. The beams 44, 46 include a plurality of spaced pre-drilled holes. A fastening mechanism 80 is mounted in the upper end of each of the tubes 20. One example is fastening mechanism illustrated in FIG. 8 that includes a dowel pin 82. This dowel pin includes a threaded aperture 84. Another example is the fastening mechanism 86 is shown in FIG. 9. This fastening mechanism 86 includes a plate with a threaded aperture or nut on the upper end of the tube 20. Another example is fastening mechanism 90 shown in FIG. 10. This fastening mechanism 90 includes a plurality of spring loaded plates 92 surrounding threaded bushing 94. The spring loaded plates 92 engage against the inner surfaces of the tubes 20 as the bushing is pulled forward. In each of these and other fastening mechanisms, bolts are inserted into the channel slot of the beams 44, 46 and into the pre-drilled holes to engage the fastening mechanism 82.

Once the beams 44, 46 have been securely tightened onto the upper ends of the tubes 20, then the fasteners 70 and spring nuts 62 are securely tightened. This creates a secure and rigid lower shell for the crate 10.

Figure 7:
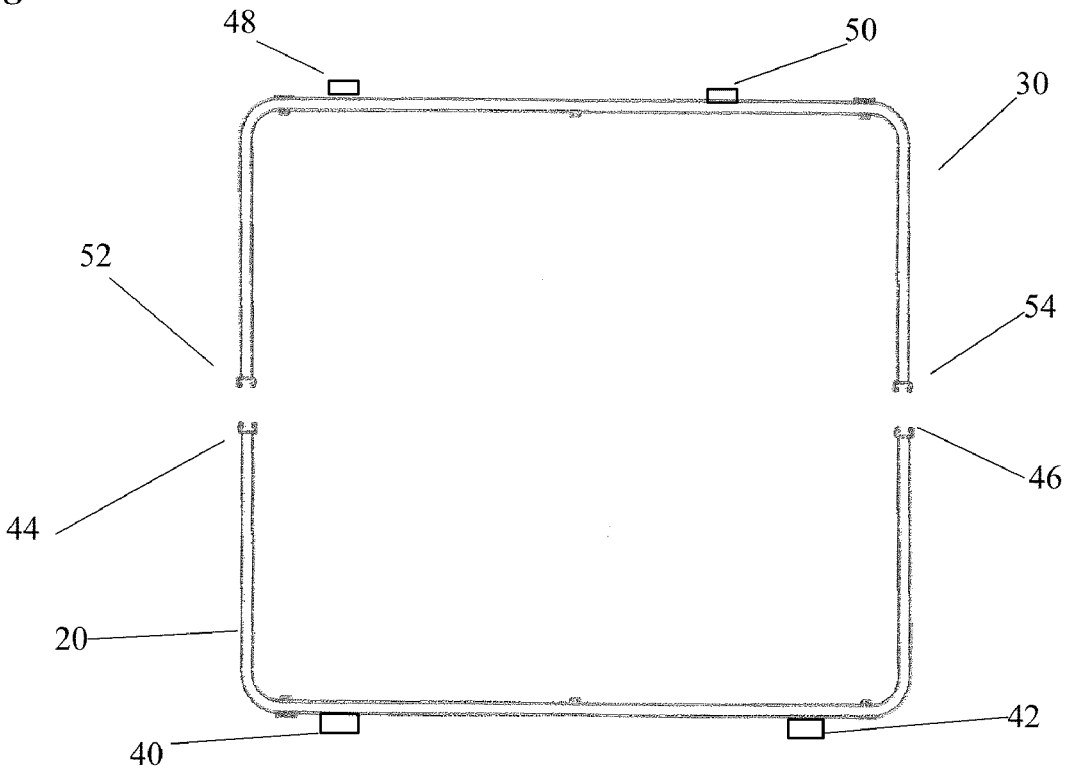
FIG. 7 illustrates an end view of a partial assembly of the embodiment of FIG. 1.
Figure 8:
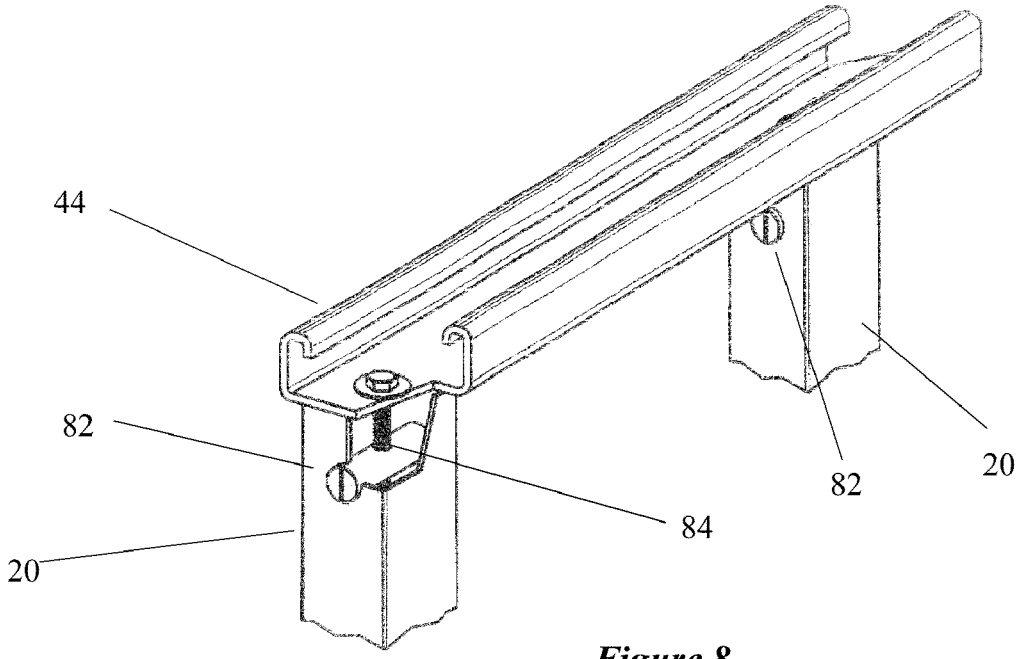
FIG. 8 illustrates a preferred fastening system used in the embodiment of FIG. 1.
Figure 10:
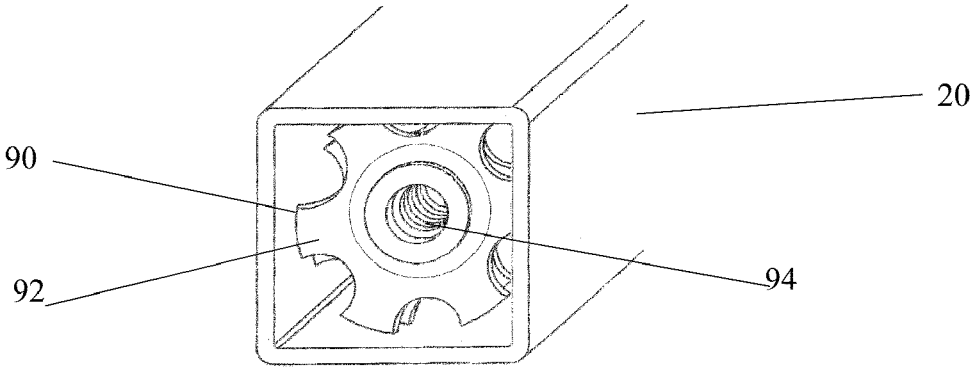
FIG. 10 illustrates another alternative fastening system.
Figure 11:
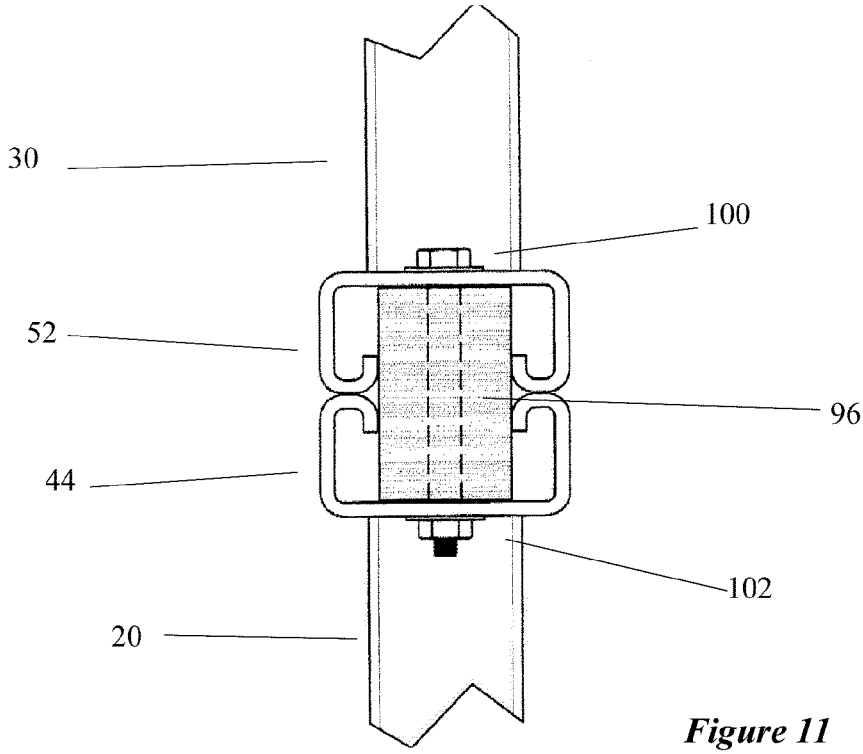
FIG. 11 illustrates a securing system used in the preferred embodiment of FIG. 1.
Figure 12:
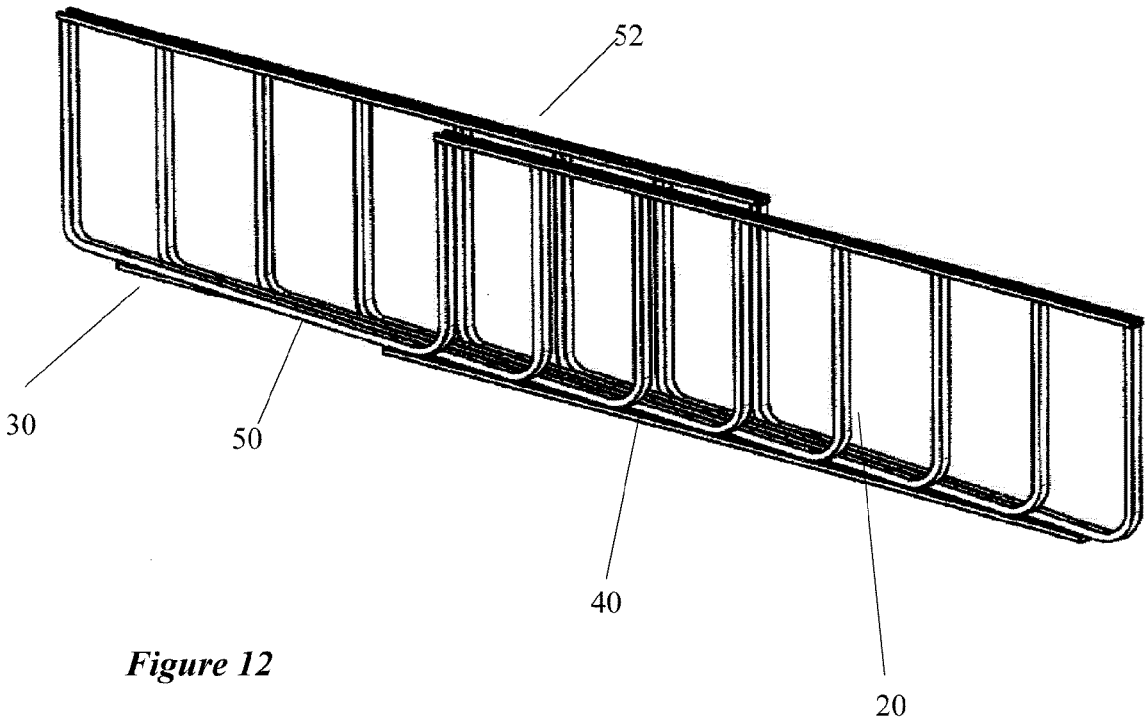
FIG. 12 illustrates a collapsed section of the crate system of the embodiment of FIG. 1.

The upper shell is created in an identical fashion using tubes 30 and beams 48, 50 and surface beams 52, 54. Once the upper shell has been assembled, then the entire crate can be assembled, as shown in FIGS. 7 and 11. The upper shell is inverted and set down onto the lower shell so that the surface beams 44, 46 of the lower shell mate against the surface beams 52, 54 of the upper shell. In the preferred embodiment as shown in FIG. 10, a wooden, plastic, metal or other material slat 96 is inserted to engage in both of the slots 56 of the surface beams 44, 46, 52, 54 respectively. This slat maintains the alignment of the lower shell and the lower shell during assembly and during use. A bolt and nut assembly 100, 102 are then used to secure the upper shell and the lower shell together.

Figure 2:
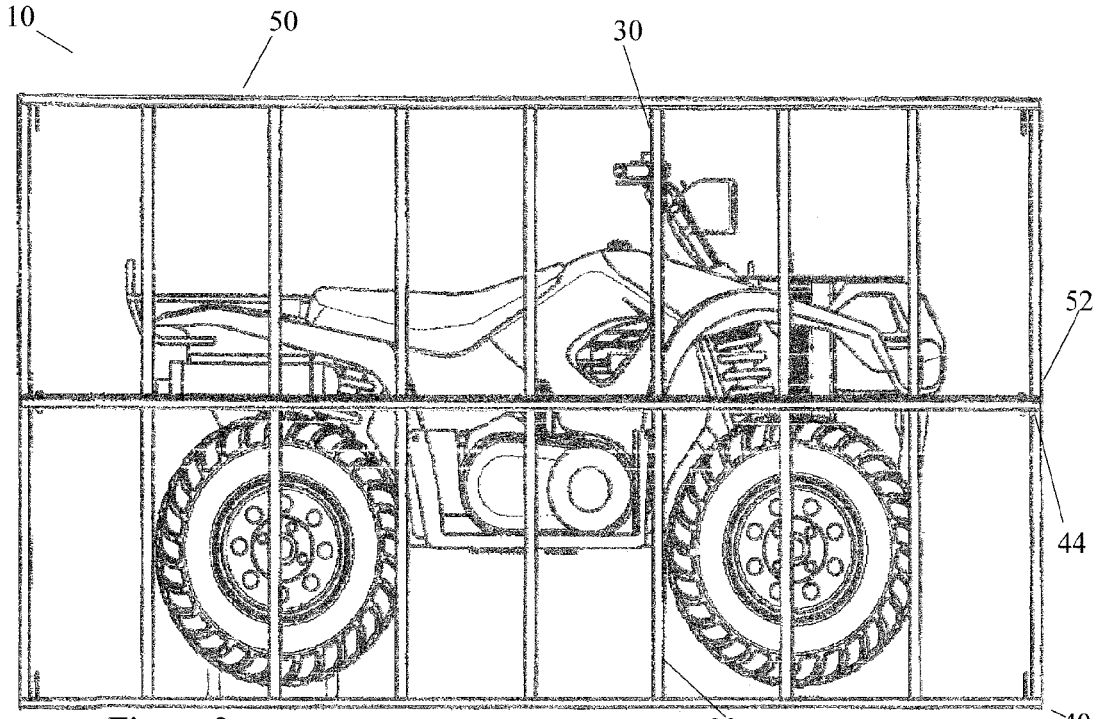
FIG. 2 illustrates a side view of the crate system of FIG. 1 with an all terrain vehicle packed inside of it.

The assembled crate is shown in FIGS. 1 and 2. In the preferred embodiment, the crate 10 is scaled particularly for use in the shipment of all terrain vehicles ("ATV"), snowmobiles, personal watercraft or other larger, heavier items. This enables the crate to be strong, rigid but also relatively light compared with wooden crates that have been previously used. The tubes 20 can also be selectively reinforced at key locations if that is necessary as well by adding additional tubes at that location. The crates can be safely stacked onto one another even when fully loaded. Also, the crates can be easily inspected. The crates may be left open, but more preferably are either shrink wrapped or covered with cardboard.

Once the crate has been transported or is otherwise ready for the item to be removed, the crate is easily opened. The crate will have suffered no or minimal damage so it can be immediately and safely reused. However, if the crate is not needed, it can be quickly and compactly disassembled. The crate can be disassembled by removing the fastening assemblies 100 so the upper shell can be separated from the lower shell. Then the fastening mechanism 80 can be removed so the surface beams 44, 46 and 52, 54 can be removed from the tubes 20 and 30 respectively. The fasteners 70 can be loosened to allow the tubes 20, 30 to simply collapsed as shown in FIG. 13 to allow the storage of the crate 10. Another alternative is to remove the fasteners to allow the tubes 20, 30 and beams 40-54 to be packed into a relatively compact shipment to be returned to the original destination.

Other embodiments of the crate system of the present invention are considered to be within the scope of the claimed invention. The crate 10 can be scaled to create any size of crate by changing the size and or number of tubes 20, 30 and beams. Also, different material choices may be used as well depending on the weight and size of the item(s) to be shipped as well as the cost efficiencies desired.

Another preferred embodiment of the present invention utilizes only the lower shell as described above. Items are packed within the lower shell and then covered by either a top or simply by shrink wrapping.

Another preferred embodiment uses rectangular or oval shaped tubes instead of the U shaped tubes with a lower and upper shell structure. The crate system of this embodiment is assembled with the beams without the need of the surface beams that were necessary to secure the lower shell and upper shell.

Other configurations may be used as well to perform the function of the presently claimed invention. These and other features of the present invention are considered to be within the scope of the claimed inventions.

What is claimed is:

1. A crate system for transporting items wherein said crate system comprises:

a first set of structural tubes that are substantially U shaped;

a first set of beams;

each of said first set of beams having an open slot along the length of said first set of beams extending partially across the upper surface of each of said first set of beams to form overextending lips;

a first fastening mechanism for securing said first set of structural U tubes in a spaced relationship to one another in a substantially upright position to said first set of beams by engagement through said open slots against said overextending lips;

a second set of structural tubes shaped in a substantially U shape;

a second set of beams;

each of said second set of beams having an open slot along the length of said second set of beams extending partially across the upper surface of each of said second set of beams to form overextending lips;

a second fastening mechanism for securing said second set of structural U-shaped tubes in a substantially upright position in spaced relationship to one another to said second set of beams by engagement through said open slots against said overextending lips; and a securing mechanism for securing said assembled first set of structural U-shaped tubes to said assembled second set of structural U-shaped tubes.

2. The crate system of claim 1 wherein said first set of structural U-shaped tubes first fastening mechanism includes:

spring nuts mounted in said open slot and a threaded fastener engaging through each of said first set of structural tubes into said spring nuts.

3. The crate system of claim 1 wherein said securing mechanism includes at least one beam extending the length of said crate and fasteners securing said assembled first set of structural tubes to said assembled second set of structural tubes.

4. The crate system of claim 1 at least one channel member extending the length of said crate and fasteners securing said assembled first set of structural tubes to said assembled second set of structural tubes.

5. A method for using a crate system for transporting items wherein said method comprises:

providing a first set of structural substantially U-shaped tubes;

providing a first set of beams having an open slot extending partially across the upper surface of each of said first set of beams forming overextending lips;

providing a first fastening mechanism; and securing said first set of structural tubes in a spaced relationship to one another in a substantially upright position to said first set of beams by said first fastening mechanism engaging through said open slots against said overextending lips;

providing a second set of structural tubes shaped in a substantially U shape;

providing a second set of beams;

providing a second fastening mechanism;

securing said second set of structural U-shaped tubes in a substantially upright position in spaced relationship to one another to said second set of beams with said second fastening mechanism;

providing a securing mechanism; and securing said assembled first set of structural U-shaped tubes to said assembled second set of structural U-shaped tubes with said securing mechanism.

6. The method of claim 5 wherein said method further includes:

said step of providing said first set of structural tubes includes shaping each of said first set of structural tubes in a substantially U shape; and providing spring nuts on said first fastening mechanism mounted in said open slot and a threaded fastener engaging through each of said first set of structural tubes into said spring nuts.

7. The method of claim 5 wherein said method further includes:

securing said assembled first set of structural tubes to said assembled second set of structural tubes wherein said securing mechanism includes at least one beam extending the length of said crate and fasteners securing said assembled first set of structural tubes to said assembled second set of structural tubes with said securing mechanism.

8. The method of claim 5 wherein said method further includes:

securing said assembled first set of structural U-shaped tubes to said assembled second set of structural U-shaped tubes with said securing mechanism wherein said securing mechanism includes at least one beam extending the length of said crate and fasteners securing said assembled first set of structural U-shaped tubes to said assembled second set of structural U-shaped tubes.

9. The method of claim 5 wherein said method further includes:

disassembling said crate by unfastening said first set of structural U-shaped tubes from said first set of beams.

* * * * *